US009062541B2

(12) United States Patent
Metcalfe et al.

(10) Patent No.: US 9,062,541 B2
(45) Date of Patent: Jun. 23, 2015

(54) METHOD, SYSTEM AND APPARATUS FOR SUBSURFACE FLOW MANIPULATION

(75) Inventors: Guy Parker Metcalfe, Mentone (AU); Daniel Robert Lester, Bellfield (AU); Michael George Trefry, Floreat (AU); Klaus Regenauer-Lieb, Shoalwater (AU)

(73) Assignee: COMMONWEALTH SCIENTIFIC AND INDUSTRIAL RESEARCH ORGANISATION, Campbell (AU)

( * ) Notice: Subject to any disclaimer, the term of this patent is extended or adjusted under 35 U.S.C. 154(b) by 377 days.

(21) Appl. No.: 13/384,734

(22) PCT Filed: Aug. 13, 2010

(86) PCT No.: PCT/AU2010/001040

§ 371 (c)(1), (2), (4) Date: Jul. 16, 2012

(87) PCT Pub. No.: WO2011/017771

PCT Pub. Date: Feb. 17, 2011

(65) Prior Publication Data

US 2012/0273205 A1 Nov. 1, 2012

(30) Foreign Application Priority Data

Aug. 14, 2009 (AU) ..... 2009903821

(51) Int. Cl.
*E21B 43/16* (2006.01)

(52) U.S. Cl.
CPC ..... *E21B 43/16* (2013.01)

(58) Field of Classification Search
CPC ..... E21B 43/16; E21B 43/164; E21B 43/17; E21B 43/20; E21B 43/24; E21B 43/00; E21B 43/12; E21B 43/25
USPC ..... 166/306, 268, 400, 402, 272.6, 272.3, 166/245
See application file for complete search history.

(56) References Cited

U.S. PATENT DOCUMENTS

| | | | | |
|---|---|---|---|---|
| 3,393,735 | A * | 7/1968 | Hoyt et al. | 166/245 |
| 3,563,312 | A | 2/1971 | Zwicky | |
| 5,246,071 | A * | 9/1993 | Chu | 166/245 |
| 5,620,593 | A | 4/1997 | Stagner | |
| 6,808,693 | B2 * | 10/2004 | Arnaud et al. | 423/212 |
| 2004/0065439 | A1 * | 4/2004 | Tubel et al. | 166/250.15 |
| 2011/0293492 | A1 * | 12/2011 | Gustafson et al. | 423/3 |

FOREIGN PATENT DOCUMENTS

| | | |
|---|---|---|
| WO | WO 2005/043706 A2 | 5/2005 |
| WO | WO 2006/002325 A2 | 1/2006 |

* cited by examiner

*Primary Examiner* — Brad Harcourt
(74) *Attorney, Agent, or Firm* — Sughrue Mion, PLLC

(57) ABSTRACT

Described embodiments relate to methods, systems and infrastructure for flow manipulation within a porous volume. Some embodiments relate to a method of subsurface flow manipulation, comprising:

providing fluid at a first subsurface location adjacent to or in a subsurface volume through which the fluid is to pass;

providing first suction at a second subsurface location adjacent to or in the subsurface volume to extract fluid from the subsurface volume, the second subsurface location being located across at least part of the subsurface volume from the first subsurface location;

providing fluid at a third subsurface location spaced from the first subsurface location and adjacent to or in the subsurface volume; and providing second suction at the first, second or a fourth subsurface location adjacent to the subsurface volume to extract fluid from the subsurface volume.

14 Claims, 8 Drawing Sheets

METHOD, SYSTEM AND APPARATUS FOR SUBSURFACE FLOW MANIPULATION

CROSS REFERENCE TO RELATED APPLICATION

This application is a National Stage of International Application No. PCT/AU2010/001040, filed on Aug. 13, 2010, claiming priority based on Australian Patent Application No. 2009903821, filed Aug. 14, 2009, the contents of all of which are incorporated herein by reference in their entirety.

TECHNICAL FIELD

Described embodiments relate generally to methods, systems, apparatus and infrastructure for flow manipulation through porous volumes, such as subsurface volumes.

BACKGROUND

Subsurface geological structures and volumes may contain various minerals, fluids or gases that may be desired to be extracted. Where a subsurface volume contains media that is sufficiently porous to allow fluid to pass therethrough, or in which sufficient porosity can be induced, processes involving inducing fluid flow from one subsurface well to another through such volumes may be used to extract minerals or otherwise make use of constituents or properties of the subsurface volume. However, with such processes, there is limited scope to control the process dynamics within the porous media.

For example, in geothermal heat extraction using two spaced wells, the majority of heat is removed from rock local to the path of least resistance between the carrier fluid injection and recovery wells, with the consequence that thermal recovery from surrounding rock is limited by the usually very slow diffusion of heat.

It is desired to address or ameliorate one or more shortcomings or disadvantages associated with prior fluid-based extraction processes, or to at least provide a useful alternative thereto.

SUMMARY

Certain embodiments relate to a method of subsurface flow manipulation, comprising:

- providing fluid at a first subsurface location adjacent to or in a subsurface volume through which the fluid is to pass;
- providing first suction at a second subsurface location adjacent to or in the subsurface volume to extract fluid from the subsurface volume, the second subsurface location being located across at least part of the subsurface volume from the first subsurface location;
- providing fluid at a third subsurface location spaced from the first subsurface location and adjacent to or in the subsurface volume; and
- providing second suction at the first, second or a fourth subsurface location adjacent to the subsurface volume to extract fluid from the subsurface volume.

The first suction may be provided after a first predetermined period from the fluid being provided at the first subsurface location. The second suction may be provided after a second predetermined period from the fluid being provided at the third subsurface location. Providing fluid and suction may be performed to induce cross-directional flows of fluid through the subsurface volume. Cross-directional flows may be induced to occur in sequence and the cross-directional flows may be induced in at least three different directions through the subsurface volume. Providing fluid and providing suction may be performed repeatedly in sequence.

Some embodiments relate to a method of subsurface flow manipulation, comprising:

- providing fluid at at least first and second spaced subsurface locations about a porous subsurface volume;
- extracting fluid at at least third and fourth spaced subsurface locations around the subsurface volume so that fluid travelling through the subsurface volume from the at least first and second spaced locations is forced to take different paths to the at least third and fourth spaced locations.

Providing and extracting may be performed in sequence and providing fluid at the first subsurface location may be performed before the extracting at the third subsurface location. Providing fluid at the second subsurface location may be performed after the extracting at the third subsurface location and extracting at the fourth subsurface location may be performed after the providing at the second subsurface location and after the extracting at the third subsurface location.

At least three of the first, second, third and fourth subsurface locations may be distinct. The extracting may be performed a predetermined time after the providing. At least third and fourth subsurface locations may be sufficiently spaced and positioned to cause flows in generally crossing directions as the fluid travels through the subsurface volume. The method may involve repeating the providing and extracting. The fluid may comprise a gas or a liquid. The fluid may consist of a gas or a liquid.

Some embodiments relate to a method of flow manipulation comprising:

- providing a first fluid flow through a porous volume between a first fluid source and a first fluid sink;
- providing a second fluid flow through the porous volume between a second fluid source and a second fluid sink distinct from the first fluid source and the first fluid sink, the second fluid flow having a second directional orientation different from a first directional orientation of the first fluid flow.

The porous volume may be a subsurface volume, such as underground rock or sands. Some embodiments may be used for heap leaching, where the porous volume may not be strictly below the earth's surface or may be in an open pit, for example.

The described methods may be used to extract minerals, gases or liquids from the subsurface volume. Alternatively, the described methods may be used to extract heat from the subsurface volume or transfer heat thereto. Alternatively, the described methods may be used to sequester substances within the subsurface volume or promote chemical reactions with substances in the subsurface volume.

Some embodiments relate to a system comprising surface and subsurface infrastructure configured to perform the methods described herein.

Some embodiments relate to a system for subsurface flow manipulation comprising:

- at least first, second and third wells positioned about a subsurface volume and configured to supply and extract fluid from a base of the respective well;
- a fluid source;
- an extracted fluid destination; and
- a control system configured to control supply of fluid from the fluid source to the base and extraction of fluid from the base to the extracted fluid destination, the fluid supply and extraction being controlled through the at least first, second and third wells in sequence so that fluid flows of different directions and having generally different paths through the subsurface volume are induced between different ones of the at least first, second and third wells.

The control system may control the supply and extraction according to a timing sequence, wherein the timing sequence may include a first predetermined delay between an end of the supply and a beginning of the extraction. The timing sequence may also include a second predetermined delay between an end of the extraction and a beginning of a subsequent supply. The sequence may be a repeated sequence. The different directions may be separated by at least 30°. At least one of the at least first, second and third wells may comprise fluid supply and extraction conduits within a single well bore.

Some embodiments may be used to establish a kinematic flow barrier around part of the subsurface volume.

Some embodiments relate to a method of subsurface flow manipulation, comprising:

providing at least three wells positioned about a subsurface volume and configured to supply and extract fluid from a base of the respective well;

operating a first subset of the wells for a first time period to cause fluid to travel part-way through the subsurface volume in a first general direction;

operating a second subset of the wells for a second time period to cause fluid to travel part-way through the subsurface volume in a second general direction displaced at a first acute angle from the first direction;

operating a third subset of the wells for a third time period to cause fluid to travel part-way through the subsurface volume in a third general direction displaced at a second acute angle from the first direction that is greater than the first acute angle;

wherein the first, second and third time periods and the first and second acute angles are selected to cause some of the injected fluid to remain within the subsurface volume during the operating of at least the first, second and third subsets of wells.

The method may comprise, after the operating, extracting the fluid through at least one of the wells. The method may comprise, prior to operating the first subset of wells, operating at least one of the wells to inject fluid into the subsurface volume.

The operating may be performed using sequenced subsets of all of the at least three wells to establish a flow pattern that generally contains a volume of fluid within the subsurface volume. This containment may effectively be provided by inducement of a flow pattern that establishes a kinematic flow barrier around part of the volume and out of which fluid flow is hindered.

DETAILED DESCRIPTION

Embodiments generally relate to methods, systems, apparatus and infrastructure for flow manipulation within a porous volume, which may be a subsurface volume. Such embodiments generally employ techniques and apparatus to induce fluid flows through a porous volume where the flows have generally different directional orientations, so that fluid flowing through the porous volume is forced to take at least some different paths through the porous volume. In this way, fluid permeation and flow through the porous volume is increased in comparison to arrangements that use only two spaced locations as the source and sink for fluid flowing through the subsurface volume.

Some embodiments are generally contemplated to be used in relation to a subsurface (i.e. underground) volume of interest, such as naturally occurring porous rocks or sands, having chemical, mineral, kinetic energy (i.e. temperature) or other qualities that can be harnessed by passing fluid through such a volume. Specific examples of such uses include heat extraction, mineral extraction, carbon sequestration and gas and/or fluid extraction. Some embodiments contemplate use of differently directed induced flows through a porous volume that need not be naturally occurring or underground. Such embodiments include, for example, heap leaching of tailings, fractured ore or other porous materials.

Embodiments generally operate on the principle that differently directed flows of fluid, which may include twisted, folded or cross-directional flows, through the volume of interest will generally achieve a much higher permeation and/or penetration through the subsurface volume and therefore greater efficiency of extraction or sequestration from or in the subsurface volume. To achieve this, at least three spaced points in and/or around the subsurface volume are used for providing and extracting fluid in sequence. More than three such points can be used, but three non-linear points are the minimum needed to establish flows having different directional orientations through the subsurface volume. Examples of how such flows might be achieved and controlled are described below in relation to the figures.

Figure 1:
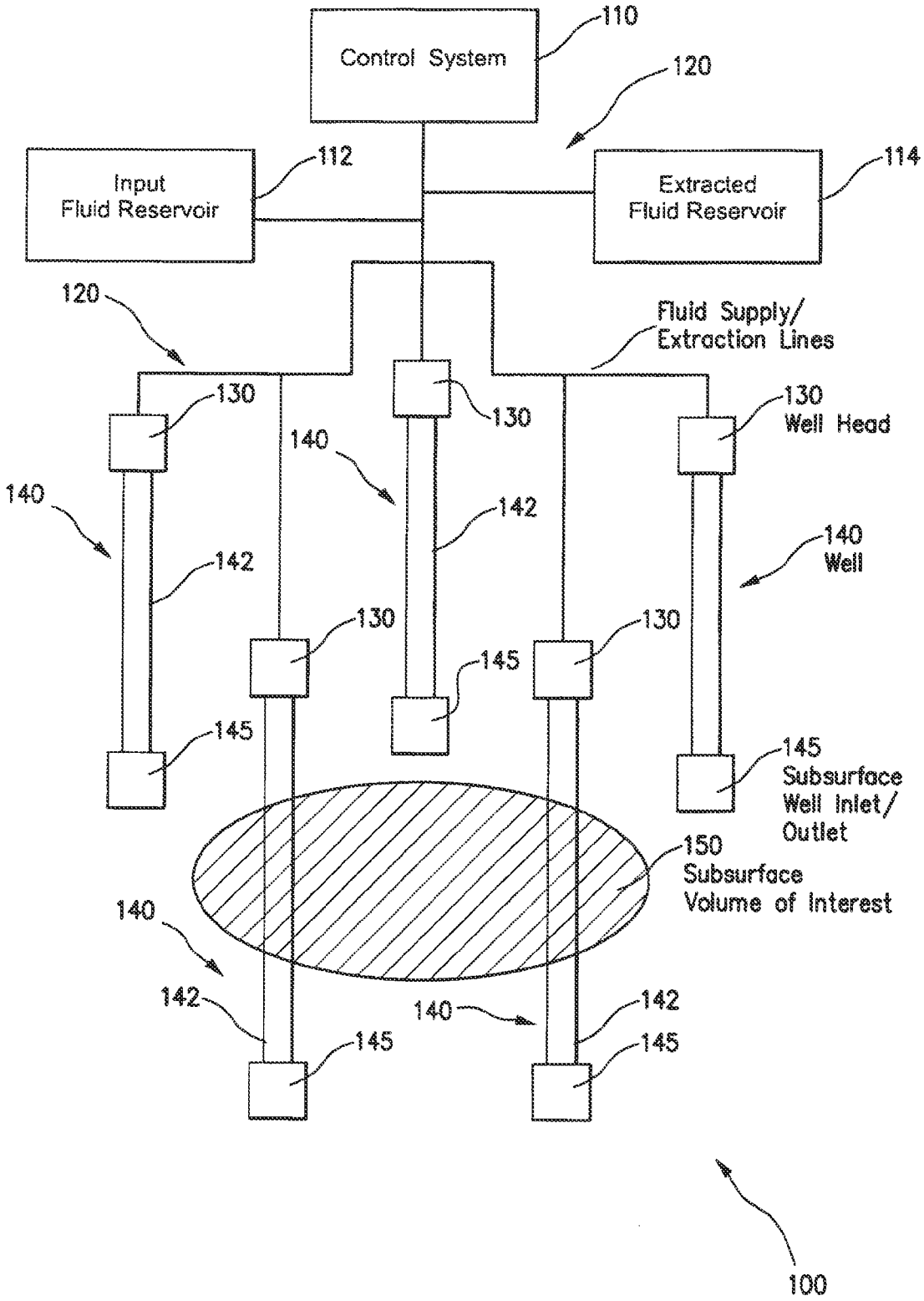
FIG. 1 is a schematic diagram of a system for subsurface flow manipulation of fluid through a subsurface volume.

Referring now to FIG. 1, a system 100 for subsurface flow manipulation of fluid through a subsurface volume 150 of interest is described. Subsurface volume 150 may be any geological volume, which may be naturally occurring, having properties of interest, for example such as properties that may be commercially exploited or studied or may be the subject of research, where the volume has sufficient porosity (or in which sufficient porosity can be induced) to allow fluid to flow through it.

In some instances, the subsurface volume 150 may not be naturally occurring, for example where a stope or pit contains a volume of tailings, fractured ore or other mined or processed porous minerals. Such volumes may be subject to heap leaching processes for example. However, for purposes of illustration only and without limitation, the volume of interest 150 will mostly be described herein as being a subsurface or underground volume.

As shown in FIG. 1 schematically, system 100 includes surface infrastructure 120 and a control system 110 arranged to control fluid flow through surface infrastructure 120. Surface infrastructure 120 may include piping, conduits, flow manipulation/control instrumentation, valving, metering and monitoring equipment, for example. Control system 110 may comprise any suitable system for control and monitoring of fluid supply and extraction and plant associated therewith, together with suitable software executing on a computer system comprised in control system 110.

System 100 further comprises a plurality of well heads 130, five of which are shown in FIG. 1 by way of illustrative example only. Three, four or more than five well heads 130 (and wells 140) may be employed in system 100. System 100 further comprises an input fluid reservoir 112 and an extracted fluid reservoir 114 fluidly coupled to surface infrastructure 120 and arranged, under the control of control system 110, to respectively supply and receive fluid to and from well heads 130 via surface infrastructure 120.

System 100 further comprises a plurality of wells 140, each having a base 145 positioned in relation to the subsurface volume 150 and fluidly coupled to well head 130 via a well bore 142. The bases 145 of wells 140 are positioned in selected locations in or adjacent subsurface volume 150 so as to be able to supply fluid into subsurface volume 150 and extract fluid from subsurface volume 150. Each base 145 may be configured to both supply and extract fluid, with appropriate supply and extraction fluid conduits 142*a*, 142*b* running between the base 145 and the well head 130. Extracted fluid may contain a mixture of liquid(s), gas(es) and/or solid particles and may contain more or less fluid than was supplied.

Figure 4:
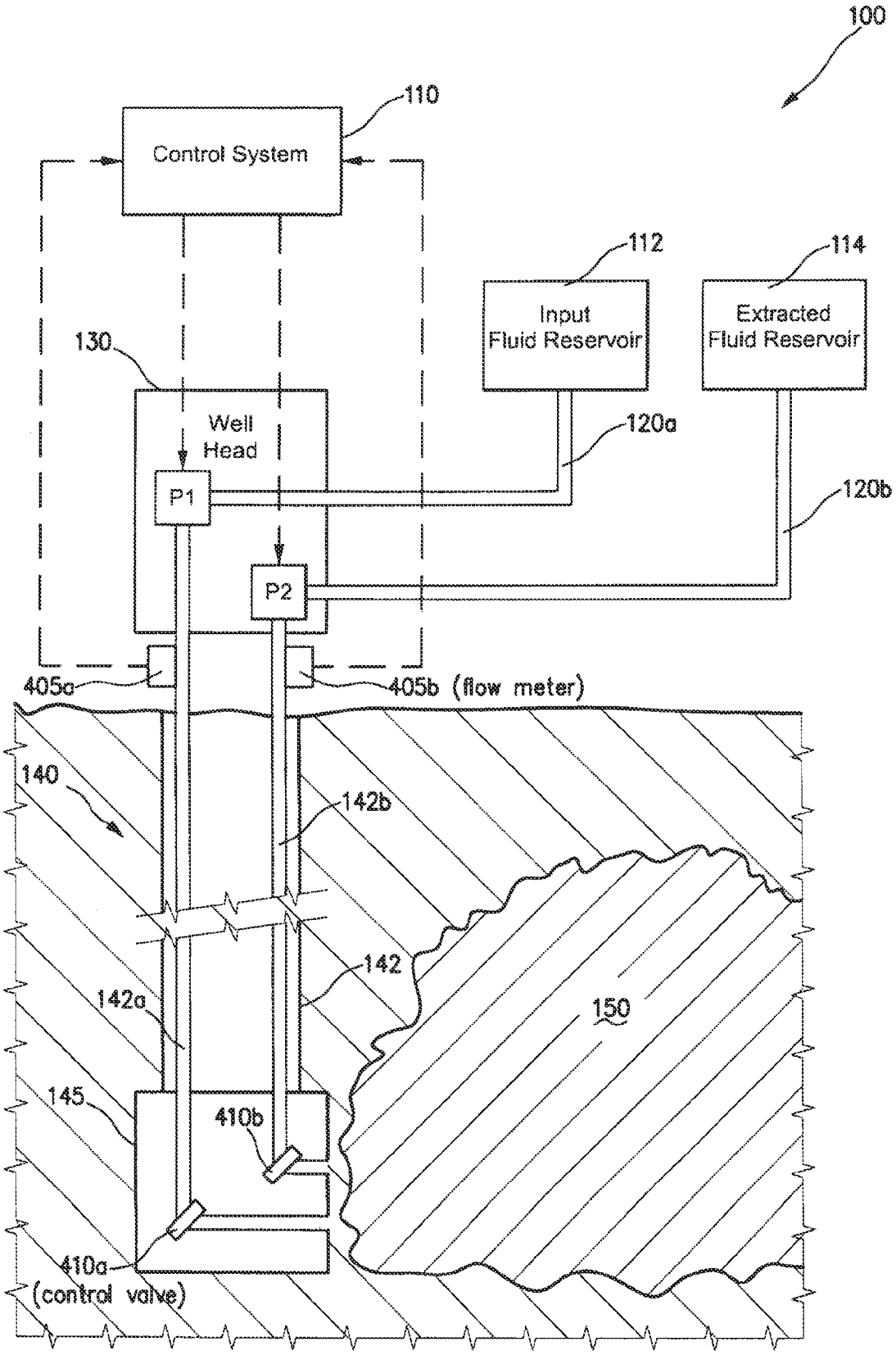
FIG. 4 is a schematic representation of surface and subsurface infrastructure forming part of the system of FIG. 1.

Referring also to FIG. 4, each well base 145 may comprise suitable structure for opening and closing the fluid supply and extraction conduits 142*a*, 142*b* that extend through well bore 142. Conduits 142*a*, 142*b* may be concentric or non-concentric. Such base structure may include, for example, a control valve 410*a* for controlling supply of fluid to subsurface volume 150 and a control valve 410*b* for controlling extraction of fluid from subsurface volume 150. Control valves 410*a* and 410*b* operate under the control of control system 110 to open and close fully or partially and thereby control fluid flow through the valves 410*a*, 410*b*.

System 100 may further comprise suitable pumps P1 and P2 (or other suitable positive or negative pressure creation means) within well head 130. Alternatively, such pumps or other pressure creation means may be located away from well head 130, but coupled to the fluid supply and extraction conduits. In FIG. 4, pump P1 is shown to be fluidly coupled to input fluid reservoir 112 via fluid supply infrastructure 120*a* to supply fluid to subsurface volume 150 via fluid supply conduit 142*a*. Pump P2 is fluidly coupled to extracted fluid reservoir 114 via fluid extraction infrastructure 120*b* to extract fluid received at the base 145 of the well 140 via fluid extraction conduit 142*b* and to communicate such extracted fluid to extracted fluid reservoir 114. Pump P2 may be configured to create a substantial negative pressure at an aperture or area of base 145 in order to induce fluid in neighbouring areas, such as in subsurface volume 150, to enter extraction conduit 142*b* when control valve 410*b* is at least partially open. Similarly, pump P1 may be configured to create substantial positive pressure in order to impel fluid from input fluid reservoir 112 (and/or another source) through supply conduit 142*a* and its control valve 410*a* (when at least partially open) through an aperture or area of base 145 and into a surrounding area, such as subsurface volume 150.

Pumps P1 and pump P2 are not operated simultaneously. Rather, because a number of hours or days may separate the supply and extraction of fluid via well 140 based on a sequence of operations executed and controlled by control system 110, pumps P1 and P2 are operated in sequence.

In alternative embodiments, a single pump or other pressure creation means may be provided within well head 130 or at another suitable location in order to supply and extract fluid to or from fluid conduits 142*a*, 142*b* in well bore 142, with suitable valving apparatus used to switch between the supply and extraction conduits when necessary. In further embodiments, a single fluid conduit may be used for supply and extraction, in conjunction with a single pump or other pressure creation means that is fluidly coupled to input fluid reservoir 112 and extracted fluid reservoir 114 via supply and extraction infrastructure 120*a*, 120*b*. Further, in some embodiments, separate well bores 142 may be used for the separate supply and extraction functions, either sharing a common well head 130 and/or base 145 or having separate well heads 130 and bases 145. In such embodiments, the number and function of supply/extraction pumps and supply/extraction control valves (in base 145) is dictated by the specific well bore and fluid supply/extraction infrastructure configurations selected.

Some embodiments may include flow meters 405*a*, 405*b* positioned and configured to measure flow rate and/or mass flow to the fluid supply conduit 142*a* and fluid extraction conduit 142*b*, respectively. Flow meters 405*a* and 405*b* may be in wired or wireless communication with control system 110 in order to enable control system 110 to monitor flow rate and/or mass, and, if necessary, control pumps P1, P2 and/or valves 410*a*, 410*b* to increase or decrease fluid flow in the respective conduits to which they are coupled. For this purpose, pumps P1 and P2 are in wired or wireless communication with control system 110 and are configured to respond to control signals from control system 110 (or another control component responsive to control system 110).

Input fluid reservoir 112 may comprise a natural body of fluid, such as an open reservoir of water, for example, or may comprise an enclosed volume, such as a tank of carbon dioxide gas, for example. Input fluid reservoir 112 may comprise more than one fluid source or may comprise a source of fluid to be mixed with a solid to be dissolved or suspended in the fluid. Thus, the precise nature of input fluid reservoir 112 is not important and, in fact, it need not comprise a distinct reservoir structure. Rather, input fluid reservoir 112 acts as a source of the fluid to be provided via well 140 to subsurface volume 150.

Extracted fluid reservoir 114 similarly need not have a specific reservoir structure. Rather, it represents a destination for fluid extracted from subsurface volume 150. Extracted fluid reservoir 114 may, in fact, comprise multiple fluid volumes resulting from separation of one or more components of fluid received via fluid extraction infrastructure 120*b*. Additionally, not all extracted fluid may reach fluid extraction reservoir 114, for example if some fluids or solids are separated, for example by filtration or another separation process, prior to being received at extracted fluid reservoir 114.

The fluid supplied to and/or extracted from subsurface volume 150 may comprise gas and/or liquid, including mixtures of gases and liquids and may comprise suspended solids or particles of solid materials. In some applications, the supplied and/or extracted fluid may consist only of liquid or only of gas.

Figure 2:
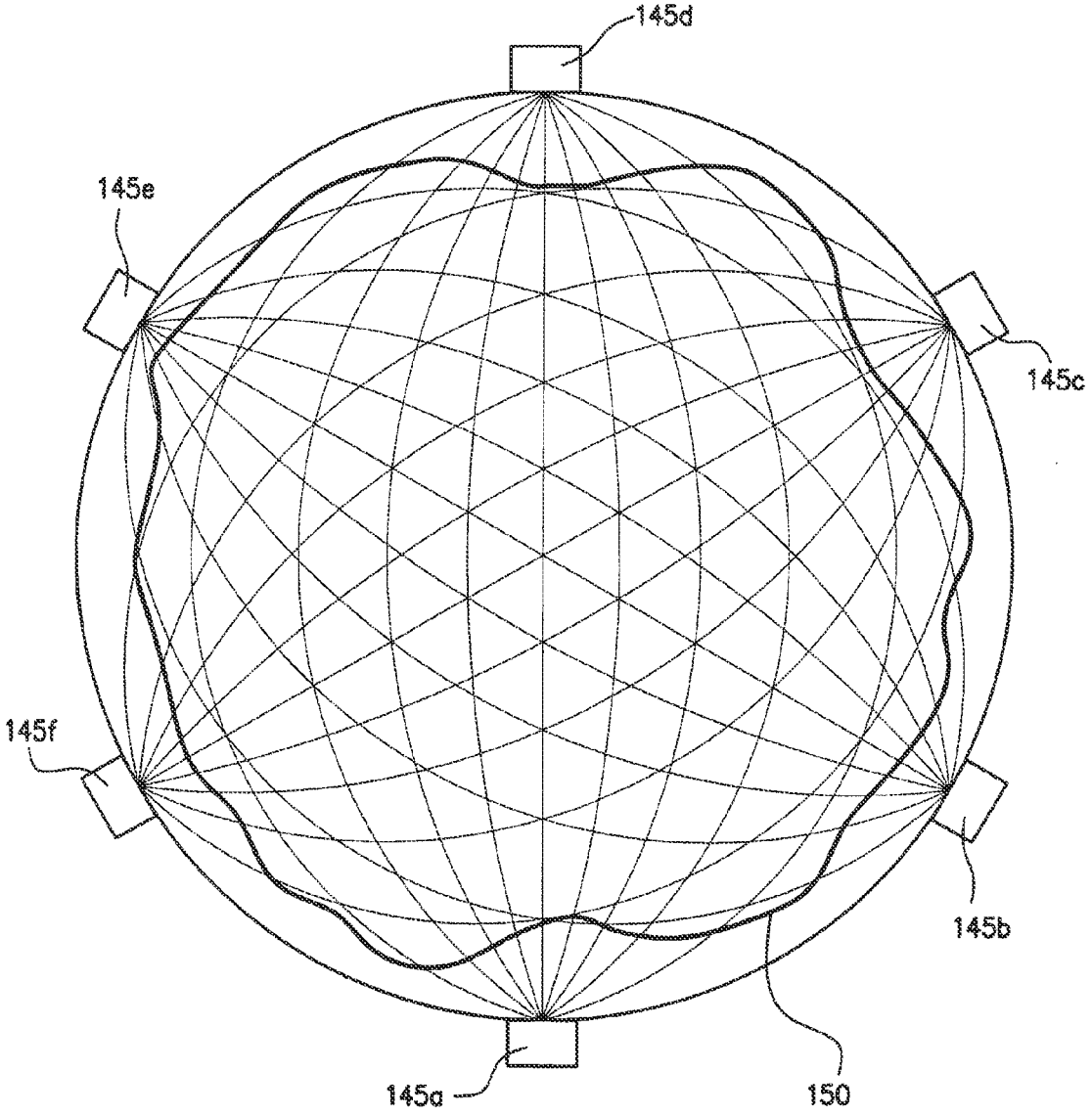
FIG. 2 is a schematic illustration of an arrangement to induce cross-flows through a subsurface volume.
Figure 3A:
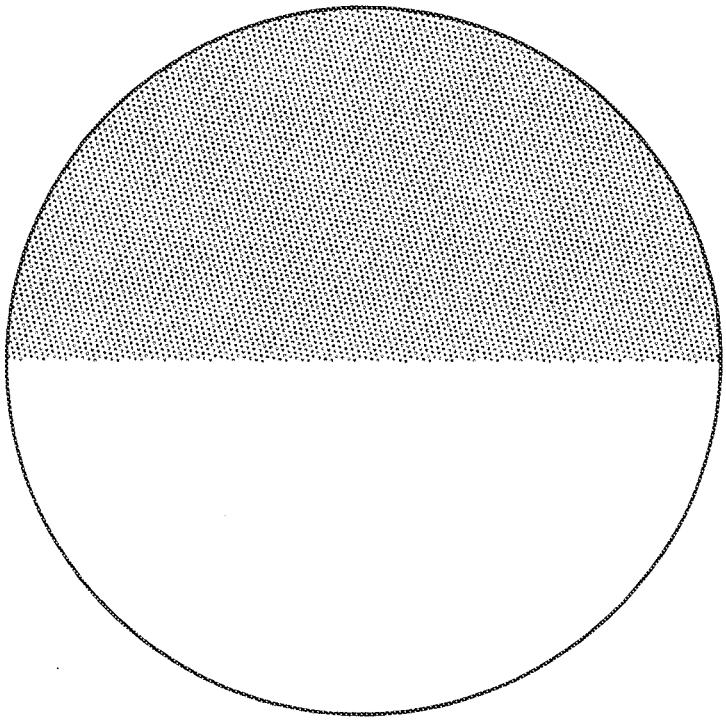
FIGS. 3A to 3F show a dyetrace progression of the effect of rotated source and sink dipole flows around a circular volume to illustrate how a mixing effect is achievable using cross flows through the subsurface volume.
Figure 3B:
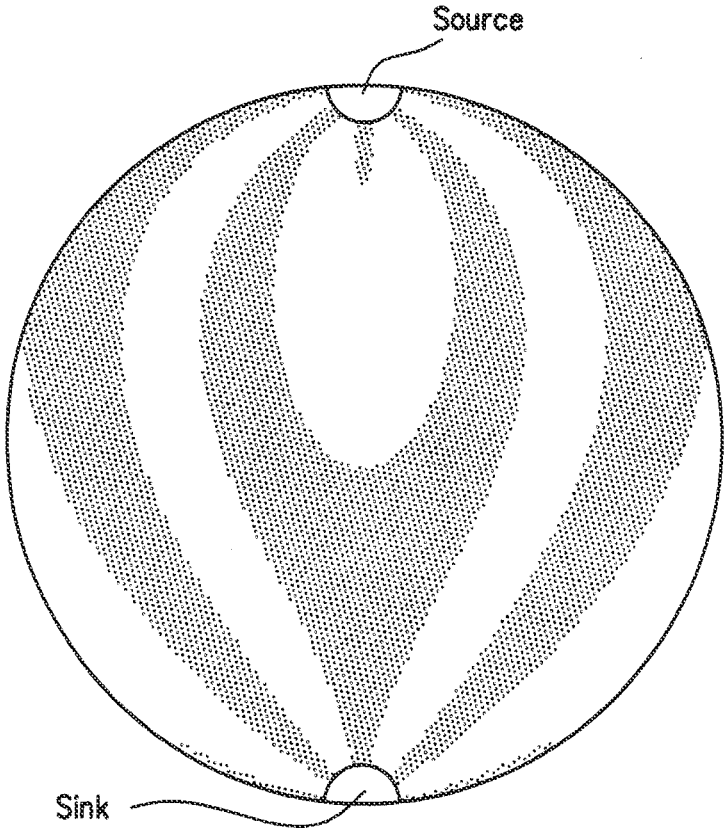
Figure 3C:
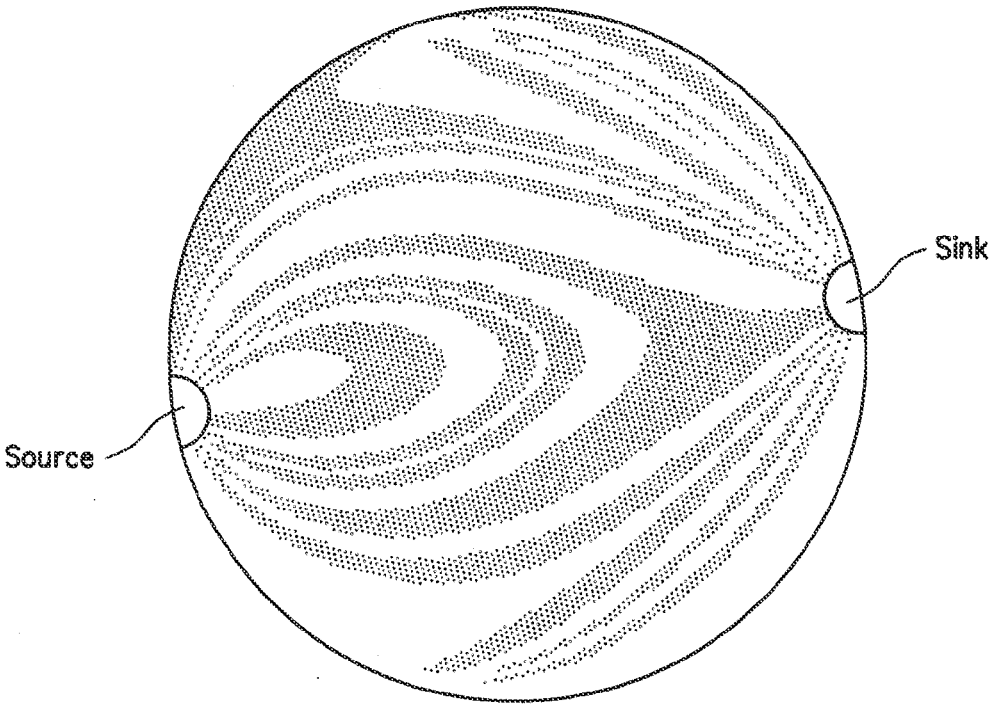
Figure 3D:
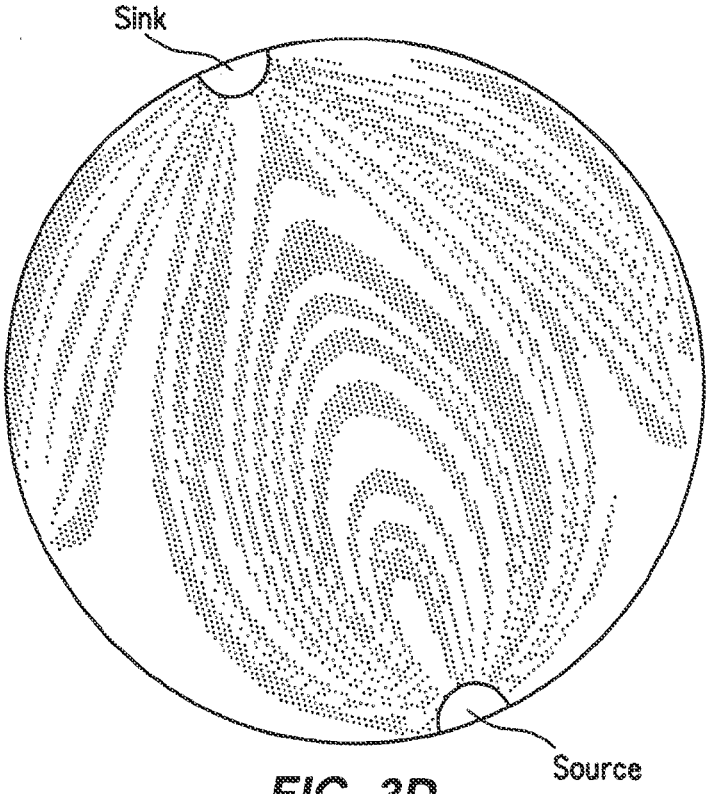
Figure 3E:
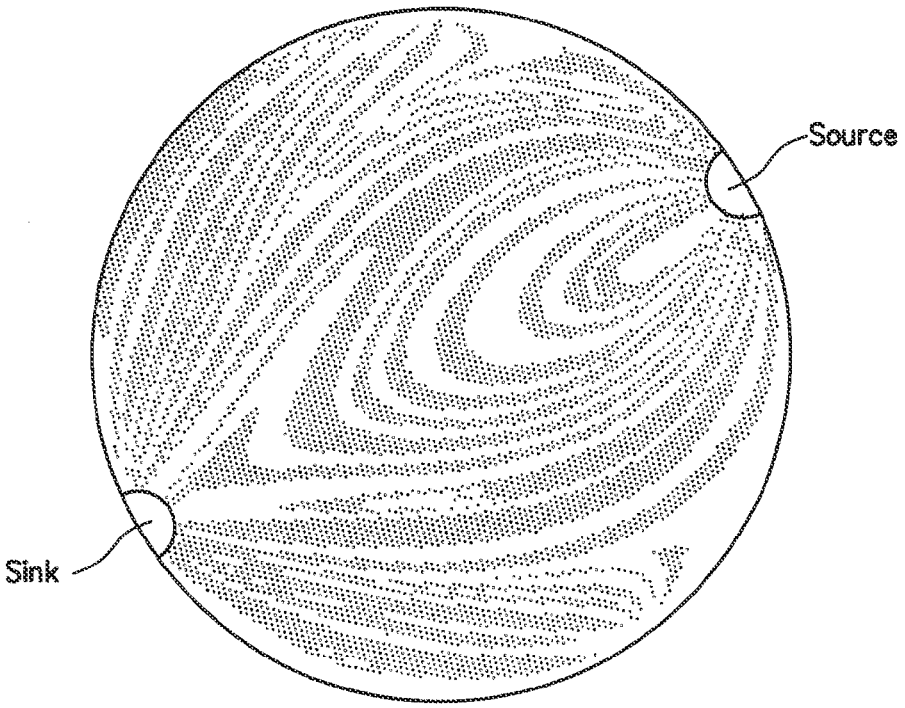
Figure 3F:
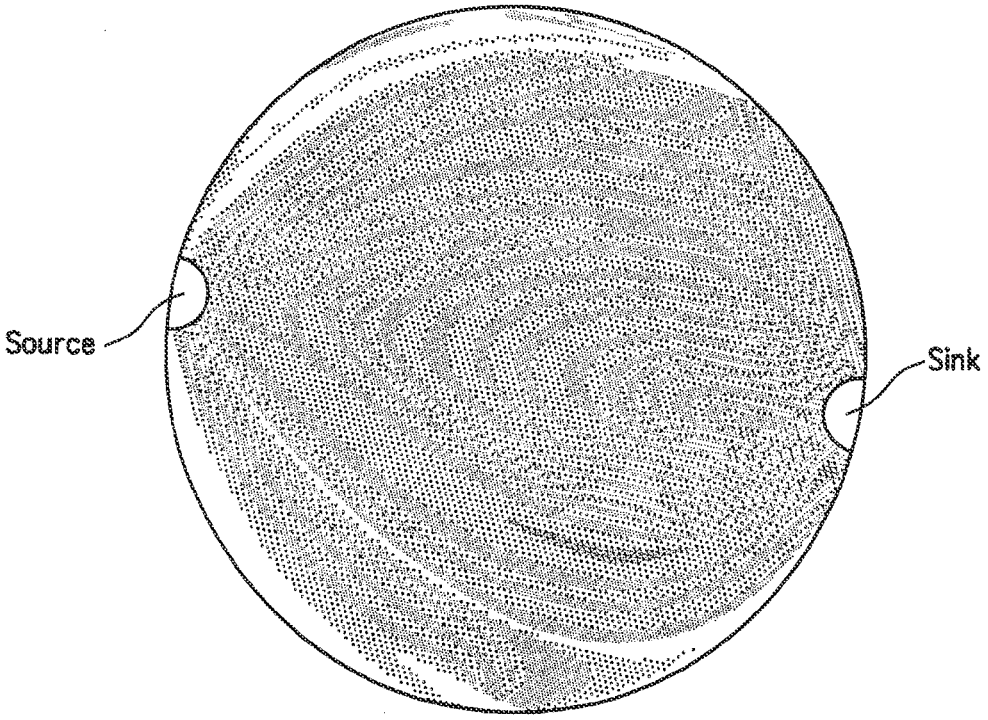

Referring now to FIG. 2, an exemplary arrangement for inducing twisting or folding flows or cross-flows through subsurface volume 150 is illustrated schematically and described in further detail. The arrangement shown in FIG. 2 illustrates an example in which six well bases 145*a* to 145*f* are shown evenly spaced about a subsurface volume of interest. Although the well bases 145*a* to 145*f* are spaced around subsurface volume 150 in a circular formation, this is only for purposes of illustration. In an in-situ installation of system 100, well bases 145 will almost never be evenly spaced around the circumference of a circle because subsurface volumes of interest 150 are likely to be unevenly shaped and to have various features or qualities that dictate the positioning of the wells around the subsurface volume in a specific manner to suit each subsurface volume of interest differently.

FIG. 2 schematically illustrates how, with as many as six spaced fluid sources and/or sinks provided by respective well bases 145*a* to 145*f*, various cross-directional fluid flows may be established through the subsurface volume 150 in a manner that can generally provide a substantially greater extent of permeation of fluid flows throughout subsurface volume 150 than would be achievable with only two wells. The arrangement illustrated in FIG. 2 indicates fluid flows in between well bases 145*a* to 145*f* positioned oppositely across the subsurface volume 150. For example, FIG. 2 illustrates the fluid flows between well base 145*a* and well base 145*d*, which is positioned on an opposite side of subsurface volume 150 to well base 145*a*. Similarly, well bases 145*b* and 145*e* are positioned opposite each other across a subsurface volume 150 and so are well bases 145*c* and 145*f*.

In such an arrangement, each well base 145 can be operated to supply fluid under pressure into subsurface volume 150 for a predetermined amount of time, such as a number of hours, minutes or seconds, while all other well bases 145*b* to 145*f* are closed. Then, after a second predetermined time, which may begin after a first delay, well base 145*d* may be opened and strong suction applied via the extraction conduit 142*b* of a respective well 140 to extract fluid from subsurface volume 150. The second predetermined time may be approximately equal to the first predetermined time or may be shorter or longer. The first delay may be measured from the start of when fluid was supplied at well base 145*a* (i.e. from the start of the first predetermined period) or from when fluid stopped being supplied from well base 145*a* (i.e. from the end of the first predetermined period).

After a second delay from the beginning or end of the first supply and extraction sequence, which in some embodiments may end up being part-way through the sequence, the next supply and extraction sequence is initiated. For example, fluid may be supplied from well base 145*b* for the first predetermined period (or another period) and, after the first delay (or another time delay), fluid is extracted from well base 145*e* for the second predetermined time period (or a different period). Further, each well base 145*c*, 145*d*, 145*e* and 145*f* may be subsequently used to supply fluid into subsurface volume 150, with the respective oppositely positioned well base 145*f*, 145*a*, 145*b* and 145*c* being used as the extraction point. For each pair of well bases 145, a same or different first predetermined period of fluid supply may be used and a same or different second predetermined period of fluid extraction may be used. In addition, a same or different first delay between the fluid supply and extraction steps may be used for each well base pair.

In addition, or alternatively, well bases 145*a* to 145*f* need not strictly be used in pairs. For example, well base 145*a* may be used as a fluid source, while well bases 145*c* and 145*e* that are not directly opposite are then used to extract fluid from subsurface volume 150. Thus, one or more than one base 145 can be used to supply fluid in the initial fluid supply step and one or more than one base 145 can be used in the succeeding fluid extraction step. Further, even if the well bases 145 are operated in pairs, it is not necessary that such pairs be directly oppositely located across the subsurface volume 150.

Although the sequence of supply and extraction may progress in a clockwise or counter-clockwise fashion around the subsurface volume 150, it is equally possible that system 100 may be used to control fluid supply and extraction in a manner that does not progress in a specific rotational direction around the subsurface volume 150. In some instances, as described further below, a series of relatively short fluid flows between opposed well bases 145 may be used to create a sort of kinematic flow barrier around subsurface volume 150 (or a part thereof). The specific order of supply and extraction among the well bases 145 located around subsurface volume 150, and whether one or more than one well base 145 is used for supply or extraction as part of a sequence of operation, is configurable according to an operational sequence determined by operational personnel operating system 100. The operation sequence may be determined taking into account the nature, qualities and parameters of subsurface volume 150, the well base 145 locations, the fluid to be supplied and extracted and the nature of what is to be sequestered in or extracted from subsurface volume 150.

Referring now to FIGS. 3A to 3F, a sequence of dyetrace images are shown that illustrate a mixing effect obtainable according to described embodiments. This mixing effect is illustrated in the context of a theoretical circular subsurface volume 150, with one half of the subsurface volume 150 being shaded grey, and the other half being white. This shading is used for illustrative purposes only and does not indicate any difference in the subsurface volume 150. In the sequence of images shown in FIGS. 3A to 3F, with FIG. 3A indicating an initial unmixed state and FIG. 3F indicating a reasonably well mixed state, each image of FIGS. 3B, 3C, 3D, 3E and 3F illustrate a successively more integrated mixing of the grey and white parts of the subsurface volume following a posited fluid supply (source) on one side of the subsurface volume 150 and fluid extraction (sink) on an opposite side thereof, with the supply and extraction points being angularly displaced (rotated) around the circular subsurface volume 150 in each successive mixing step. In the illustrated sequence, the successive angular displacement is $5\pi/9$, but in practice, different displacement angles will probably be used for each step of the sequence because the volume 150 will probably not be circular or homogenous. The substantial mixing effect is visible in FIG. 3F, particularly in comparison with FIG. 3A.

Although in some embodiments, it may be desired to mix supplied fluid with another fluid or constituent of subsurface volume 150, the described arrangements can also be used for extensively permeating fluid into the subsurface volume 150 to achieve greater efficiency of extraction, deposition, sequestration, heat transfer or reaction of the supplied fluid (or its chemical constituents) with substances or qualities of the subsurface volume 150. FIGS. 3A to 3F illustrate how application of a sequence of supply and extraction of fluid through a subsurface volume 150 in a manner that causes fluid flow in various different directions through the subsurface volume 150 can achieve significantly greater penetration, permeation or "mixing" of the fluid into the subsurface volume 150 to thereby allow a substantially greater efficiency of fluid interaction with the subsurface volume and therefore greater harvesting or use of the qualities of interest of the subsurface volume 150, compared to a simple arrangement of two wells being spaced apart.

Although embodiments have generally been described as involving wells 140 spaced and positioned so as to have well bases 145 located across the subsurface volume 150 from each other, some embodiments may employ a well 140 with a well base 145 positioned within the subsurface volume 150, while other well bases 145 are positioned within or adjacent other parts of subsurface volume 150.

Figure 5:
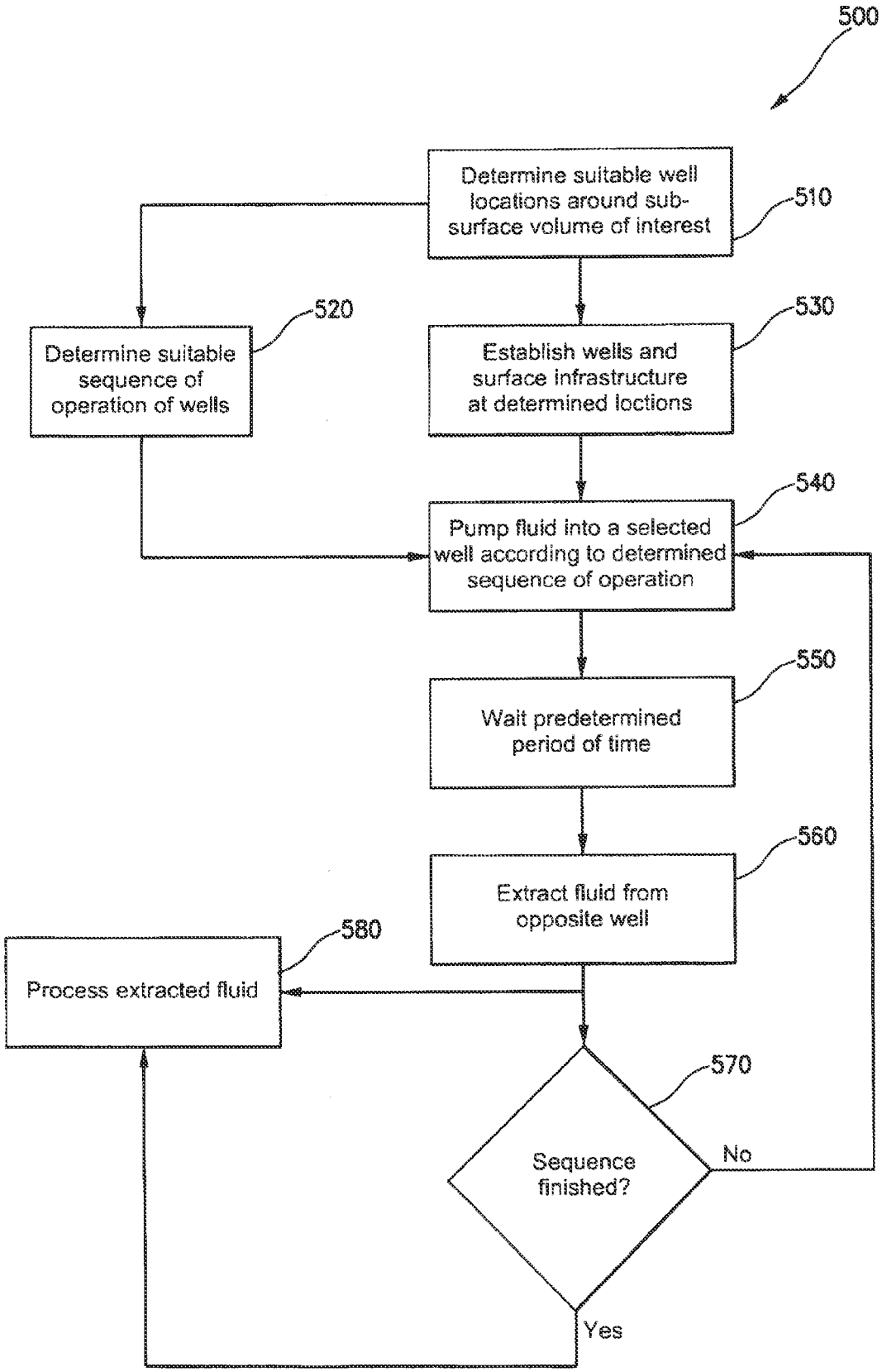
FIG. 5 is a flow chart of a method of subsurface flow manipulation.

Referring now to FIG. 5, a method 500 of subsurface flow manipulation is described and shown in further detail. Method 500 begins at step 510, where suitable well locations around and/or inside the subsurface volume of interest 150 are determined. Those determinations are made according to considerations known to those skilled in the art of harvesting or using qualities of subsurface volumes. In conjunction with step 510 or as a subsequent step, a suitable sequence of operation of the wells is determined at step 520. This determination is again made according to considerations known to those of ordinary skill in the art. At step 530, the wells and surface infrastructure are established at the determined well locations to establish system 100 in-situ around (and possibly partly within) the subsurface volume of interest 150.

In steps 540 to 580, system 100 is used to manipulate fluid flows through subsurface volume 150 to harvest or use qualities of interest of the subsurface volume 150. At step 540, fluids are pumped into one (or more than one) well 140, for example via a pump P1 in well head 130, according to the sequence of operation determined at step 520. At step 550, control system 110 causes there to be a delay (the first delay) for a predetermined period of time before extraction of fluid can be performed via another well (or more than one other well) at step 560. At step 570, control system 110 determines, by reference to the sequence of operations determined at step 520, whether the fluid supply and extraction sequence is finished. This is performed at the same time as processing of extracted fluid at step 580 through the extraction infrastructure (i.e. extracted fluid conduit 142*b*, pump P2, extracted fluid infrastructure 120*b* and extracted fluid reservoir 114). If, at step 570, the sequence of operations is determined not to have been completed, then steps 540 to 580 are repeated for a different set of fluid supply and extraction locations. If the sequence is determined to have finished at step 570, then final processing of the most recently extracted fluid is performed at step 580.

A sequence of operations determined at step 520 may be performed a number of times over a lengthy period, for example where qualities of interest of subsurface volume 150 may replenish, such as where the subsurface volume 150 is used for heat extraction. In some embodiments, subsurface volume 150 may have a finite capacity for use or may produce a finite yield of materials, minerals or energies, in which case the sequence of operations may be performed in a single substantially continuous operation over a period of time until the qualities of interest of the subsurface volume 150 are exhausted.

Method 500 may also be applied to heap leaching applications, where the leachate is supplied at a number of locations in and/or around the tailings or other porous media that make up the heap, and the pregnant leachate is then extracted at one or more of the same or different locations.

Geothermal energy generation extracts heat from subsurface reservoirs by injecting water into the reservoir and allowing the natural heat in the reservoir to transfer to the water before exiting the reservoir. If the reservoir has a high enough temperature, the hot water is extracted as steam to generate electricity using surface infrastructure. If the reservoir temperature is lower, the hot water can provide heating and cooling for buildings via heat pumps, for example.

The problem addressed by some embodiments is not insufficient heat energy in the reservoirs; rather, the problem addressed is efficiently extracting the existing heat. Subsurface reservoirs usually have highly heterogenous permeability. Injected fluid takes the path of least resistance between an injection and extraction point. Using the described methods to induce mixing of the injected fluid throughout the subsurface reservoir lets fluid pathways explore most, or at least a significantly larger proportion, of the reservoir. Moreover, the methods described herein allow the design of a stirring protocol that more closely approximates sending injected fluid ergodically through the reservoir to absorb the most heat the most quickly.

Additionally, at the rock particle-fluid interface, the actual transfer of heat energy from rock particle to fluid is mediated by a diffusive boundary layer. In steady-state operation, the width of the boundary layer controls how fast the transfer of energy between rock particle and fluid takes place. The described mixing techniques narrow this layer width and enhance heat transfer, and do this throughout the reservoir. An aspect of heat extraction is that the extracted fluid usually passes through a heat exchanger at or near the surface to extract the heat and then the same fluid is usually resupplied to the volume of interest. Thus, an input fluid reservoir 112 may only be needed to the extent that the fluid needs to be refreshed and an extracted fluid reservoir 114 may not be needed.

Mineral extraction is similar to heat extraction in that the injected fluid in traditional steady flow operation has the same drawbacks as heat extraction: one path (or at most a few paths) through the ore body predominates and a diffusive boundary layer dictates the rate of transfer of chemical species from rock particle to fluid. Subsurface mixing as described herein provides the same benefits of enhancing chemical species transfer at the rock particle-fluid interface and nearly ergodically involving the ore body in the extraction process. Differences include the injected fluid being or carrying chemicals that react with the mineral in the ore body desired to be extracted to dissolve it and carry the mineral back to the surface for recovery and separation from the carrier fluid. Other differences may arise because accounting for the chemical kinetics and chemical species diffusivity can produce different optimum stirring protocols. For example, given the exact same piece of subsurface geology, if the object is to extract heat, one subsurface stirring protocol may be optimal, while if the object is to extract a particular mineral, then a (possibly substantially) different stirring protocol may be optimal, and again if the object is to extract yet a different mineral, then again a (possibly substantially) different stirring protocol from the first two may be optimal.

The described fluid manipulation techniques generally involve effectively stirring or mixing injected fluid through the volume of interest by promoting flow through as much of the volume of interest as is practical, for example through rock fissures, pores, cracks or other paths that permit fluid flow within the volume of interest. This is achieved by inducing twisting and/or folding flows through the volume of interest between multiple spaced fluid sources and sinks, rather than just allowing the fluid to travel between two points along a path of least resistance.

Some embodiments may be applied to heap leaching applications, for example, where tailings or processed minerals having adequate porosity are deposited into a pit or stope. In such heap leaching applications, a leaching solution (leachate) can be supplied into the volume of tailings or fractured ore at spaced locations around the pit or stope and/or at one or more positions within the volume of the heap. Such injection positions can also be used as extraction points according to a desired sequence of leachate supply and extraction. This methodology provides increased permeation of the leachate through the heap than would be achievable by the prior procedure of simply trickling the leachate on top of the heap and letting it percolate down to the bottom, where the pregnant leachate is extracted. In applying the described fluid manipulation techniques to heap leaching, it is believed that substantially greater yield can be achieved in extracting desired minerals from the fractured ore or tailings in the heap.

Sequestration Example 1

Carbon sequestration is much like mineral extraction in reverse. The object is to inject carbon dioxide gas and to have it react efficiently with subsurface deposits of basaltic rock (or other sources of calcium or perhaps other minerals) to form calcite (or other stable minerals), which is a stable mineral that will not leak carbon dioxide gas. Gas that's extracted is here also reinjected and may be replenished with carbon dioxide from an input fluid reservoir 112 (which may also function as an extracted fluid reservoir 114).

Sequestration Example 2

Subsurface contaminant plumes frequently occur when waste storage sites leak. A current example is the radioactive plume coming from the Hanford nuclear facility in Washington USA and travelling towards the Columbia river. When the plume reaches the river, the ecological and economic problems of the contamination multiply.

If the various subsurface flow manipulation protocols possible using the described systems and methods are considered, there are a number of protocols that, instead of mixing fluid through the subsurface volume with crossing flows, may set up flow barriers, such that fluid that starts inside a flow barrier when stirring is started remains confined inside the barrier region indefinitely while the stirring continues. This flow barrier may be called a kinematic barrier. An example kinematic barrier is schematically illustrated using a reoriented dipole flow 600 in FIG. 6, where fluid generally inside a barrier line or region 610 defining a containment region cannot (or may find it difficult to) cross the line or region 610 and can be trapped indefinitely. In this way, migrating contaminants can be contained, for example while neutralizing chemicals are pumped into the containment region or indefinitely if no neutralizing agents currently exist.

Sequestration Example 3

In subsurface shale oil mining, heat in the form of steam or embedded electric heaters can be used to liberate hydrocarbon fluid from shale rock. In some deposits, a volume surrounding the oil deposit is frozen to prevent the liberated oil from running away before it can be pumped out. Kinematic barriers, as described above, can take the place of frozen volume barriers currently used, substantially reducing energy inputs, and the stirring motion inside the kinematic barrier may more efficiently spread heat to the entire shale deposit, thereby liberating more oil in the deposit more quickly.

In order to establish a kinematic flow barrier as described above, the systems and methods described above may be employed to operate a number of opposed well pairs in sequence, tending to establish flow paths around an interior of the subsurface volume 150, rather than simply passing through it. Such flow paths may be established by supplying and extracting fluid at different pairs of well bases 145 spaced around the subsurface volume 150 at about the same time for relatively short periods (compared to the time it would take to perform a full injection and extraction cycle from one side of the subsurface volume to another) and then switching the injecting and extracting well base pair to the next clockwise or counterclockwise pair, and so on in sequence to thereby encourage a general clockwise or counterclockwise flow around the subsurface volume 150. This assumes that there is a volume of fluid already in the subsurface volume 150.

For example, for the well base configuration shown in FIG. 2, well bases 145*a* and 145*d* may be operated to provide (at well base 145*a*) fluid and extract (at well base 145*d*) fluid simultaneously for a relatively short period of time, after which an adjacent pair (in the counter-clockwise direction) of well bases 145*b* and 145*e* are then simultaneously operated to respectively provide and extract fluid simultaneously for a relatively short period of time. In so doing, fluid that was previously travelling toward well base 145*d* when the supply/extraction direction was changed will then travel toward well base 145*e*. The next (counter-clockwise) adjacent pair of well bases 145*c* and 145*f* may be operated to respectively provide and extract fluid simultaneously for a relatively short period of time. In so doing, fluid that was previously travelling toward well base 145*e* when the supply/extraction direction was changed will then travel toward well base 145*f*, thereby inducing further continuing flow in the counter-clockwise direction, and so on.

Thus, establishment of a kinematic barrier can be performed in a similar manner to the way the subsurface mixing is performed, but with shorter intervals of flow before changing the direction of flow. To illustrate this concept further, a parcel of fluid in the reservoir is posited. The fluid supply and extraction is performed at opposed well bases 145 for a short interval and the fluid parcel moves one distance unit forward toward the extracting well base 145. Next, the supply and extraction is performed along a different direction (i.e. a different axis defined as a line between the two well bases 145) using the next clockwise (or counter-clockwise) well base pair 145 for a short interval and the fluid parcel moves to the right (or left) and proceeds a distance in that direction. Each successive change of flow direction makes the fluid parcel move to the right again some distance. If the changes of direction and amount of flow are right, the fluid parcel comes back near where it started. In this way fluid injected into the subsurface volume 150 from the surface may eventually come back out again (after following a path one revolution around the subsurface volume), but fluid that started in the subsurface volume 150 (or at least large amounts of fluid that started in the subsurface volume 150, not necessarily all of it) stays confined in the subsurface volume 150 until it is intentionally pumped out or until the stirring protocol is stopped.

Figure 6:
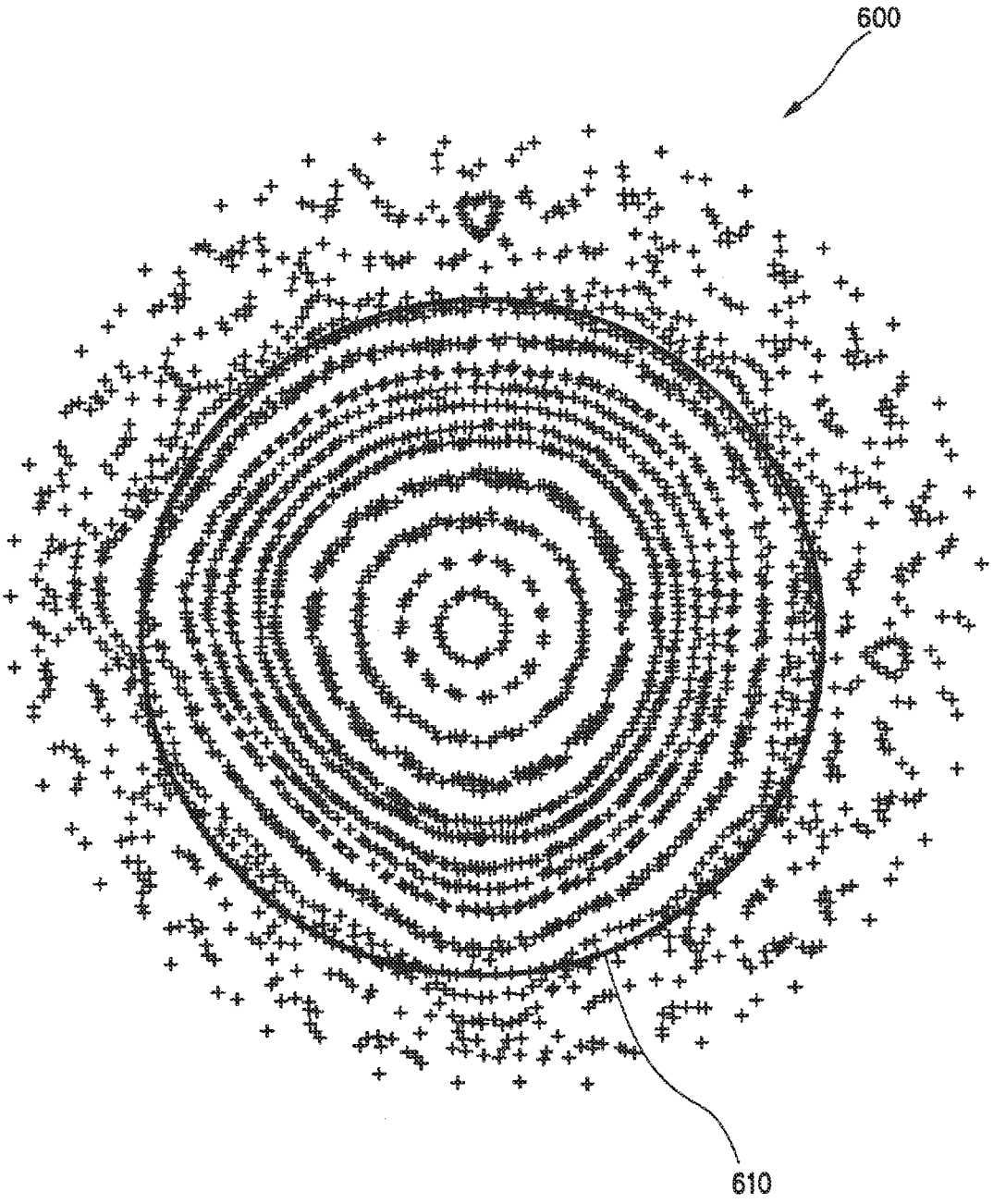
FIG. 6 is a schematic illustration of establishment of a kinematic barrier using subsurface flow manipulation.

Formation of a kinematic barrier, for example approximating barrier line 610 in FIG. 6, may be combined with an extraction or sequestration process as described herein, whereby fluid may be purposefully trapped within a kinematic barrier around the subsurface volume 150 for a period of time to encourage greater reactions of the fluid with the rock particles, either for sequestration or extraction purposes. This process can be combined with fluid extraction or supply at one or more wells positioned within a kinematic barrier that is provided by appropriate operation of an outer ring of wells.

Embodiments have been described herein by way of example and with reference to illustrative arrangements, methods and infrastructure. These embodiments are not intended to be limiting. Rather, it is contemplated that some embodiments may be subject to variation or modification without departing from the spirit and scope of the described embodiments.

Throughout this specification and claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A method of subsurface flow manipulation, comprising:

providing at least three wells positioned about a subsurface volume and configured to supply and extract fluid from a base of the respective well;

operating a first subset of the wells for a first time period to cause fluid to travel part-way through the subsurface volume in a first general direction;

operating a second subset of the wells for a second time period to cause fluid to travel part-way through the subsurface volume in a second general direction displaced at a first acute angle from the first direction;

operating a third subset of the wells for a third time period to cause fluid to travel part-way through the subsurface volume in a third general direction displaced at a second acute angle from the first direction that is greater than the first acute angle;

wherein the first, second and third time periods and the first and second acute angles are selected to cause some of the supplied fluid to remain within the subsurface volume during the operating of at least the first, second and third subsets of wells; and wherein the operating of the first, second and third well subsets is performed to cause fluid to flow in a clockwise or counter-clockwise direction in the subsurface volume.

2. The method of claim 1, wherein the fluid comprises a gas.

3. The method of claim 1, wherein the fluid comprises a liquid.

4. The method of claim 1, wherein the fluid consists of a gas.

5. The method of claim 1, wherein the fluid consists of a liquid.

6. The method of claim 1, wherein the subsurface volume is a porous volume.

7. Use of the method of claim 1, to extract minerals, gases or liquids from the subsurface volume or to extract or deliver heat from or to the subsurface volume.

8. Use of the method of claim 1, to sequester substances within the subsurface volume.

9. Use of the method of claim 1, to chemically react a constituent of the fluid with a substance in the subsurface volume.

10. Use of the method of claim 1 to conduct heap leaching of a porous volume of processed particulate.

11. The method of claim 1, further comprising, after the operating, extracting the fluid through at least one of the wells.

12. The method of claim 1, wherein the operating is performed using sequenced subsets of all of the at least three wells to establish a flow pattern that generally contains a volume of fluid within the subsurface volume.

13. The method of claim 1, further comprising, prior to the operating of the first subset of wells, operating at least one of the wells to inject fluid into the subsurface volume.

14. A system comprising surface and subsurface infrastructure configured to perform the method of claim 1.

* * * * *